United States Patent [19]

Millen

[11] Patent Number: 4,826,383

[45] Date of Patent: May 2, 1989

[54] A SHEET MECHANISM HAVING DRIVE MEANS FOR REMOVING COMPILED SHEET SETS THEREFROM

[75] Inventor: Jeffrey A. Millen, Blackmore, United Kingdom

[73] Assignee: Xerox Corporation, Stamford, Conn.

[21] Appl. No.: 511,039

[22] Filed: Jul. 5, 1983

[30] Foreign Application Priority Data

Jul. 7, 1982 [GB] United Kingdom ..... 8219714

[51] Int. Cl.[4] ..... B65H 31/30

[52] U.S. Cl. ..... 414/789.9; 29/132; 198/624; 271/274

[58] Field of Search ..... 414/35, 43; 271/221, 271/222, 245, 246, 272–274, 4, 207, 220; 29/132, 130; 198/621, 624, 780, 843; 193/37

[56] References Cited

U.S. PATENT DOCUMENTS

| | | | |
|---|---|---|---|
| 3,467,009 | 9/1969 | Ross | 29/130 |
| 3,556,512 | 1/1971 | Fackler | 271/4 |
| 3,622,059 | 11/1971 | Savela | 29/132 X |
| 3,662,446 | 5/1972 | Walls | 29/130 |
| 3,719,266 | 3/1973 | Korn et al. | 271/221 X |
| 3,972,525 | 8/1976 | Foster et al. | 271/221 |
| 4,287,409 | 9/1981 | Auchinleck | 271/274 X |
| 4,287,649 | 9/1981 | Kohler | 29/130 |
| 4,453,870 | 6/1984 | Bean | 414/43 |

FOREIGN PATENT DOCUMENTS 1595609 8/1981 United Kingdom .

*Primary Examiner*—Robert J. Spar
*Assistant Examiner*—Lyle K. Kimms
*Attorney, Agent, or Firm*—William A. Henry, II

[57] ABSTRACT

A sheet stacker in which sheets are compiled in a tray (71) against registration (74) and a completed set is ejected, the registration members (74) being retracted, by an eject mechanism comprising a continuously rotating drive roller (80) projecting through the base (72) of the tray and a coacting idler roller (81) mounted on a spring arm (82) which is retracted during stacking and then pressed against the top of the completed set to effect ejection. Preferably the roller (80) is a deformable roller having a low coefficient of friction surface.

5 Claims, 5 Drawing Sheets

A SHEET MECHANISM HAVING DRIVE MEANS FOR REMOVING COMPILED SHEET SETS THEREFROM

Figure 1:
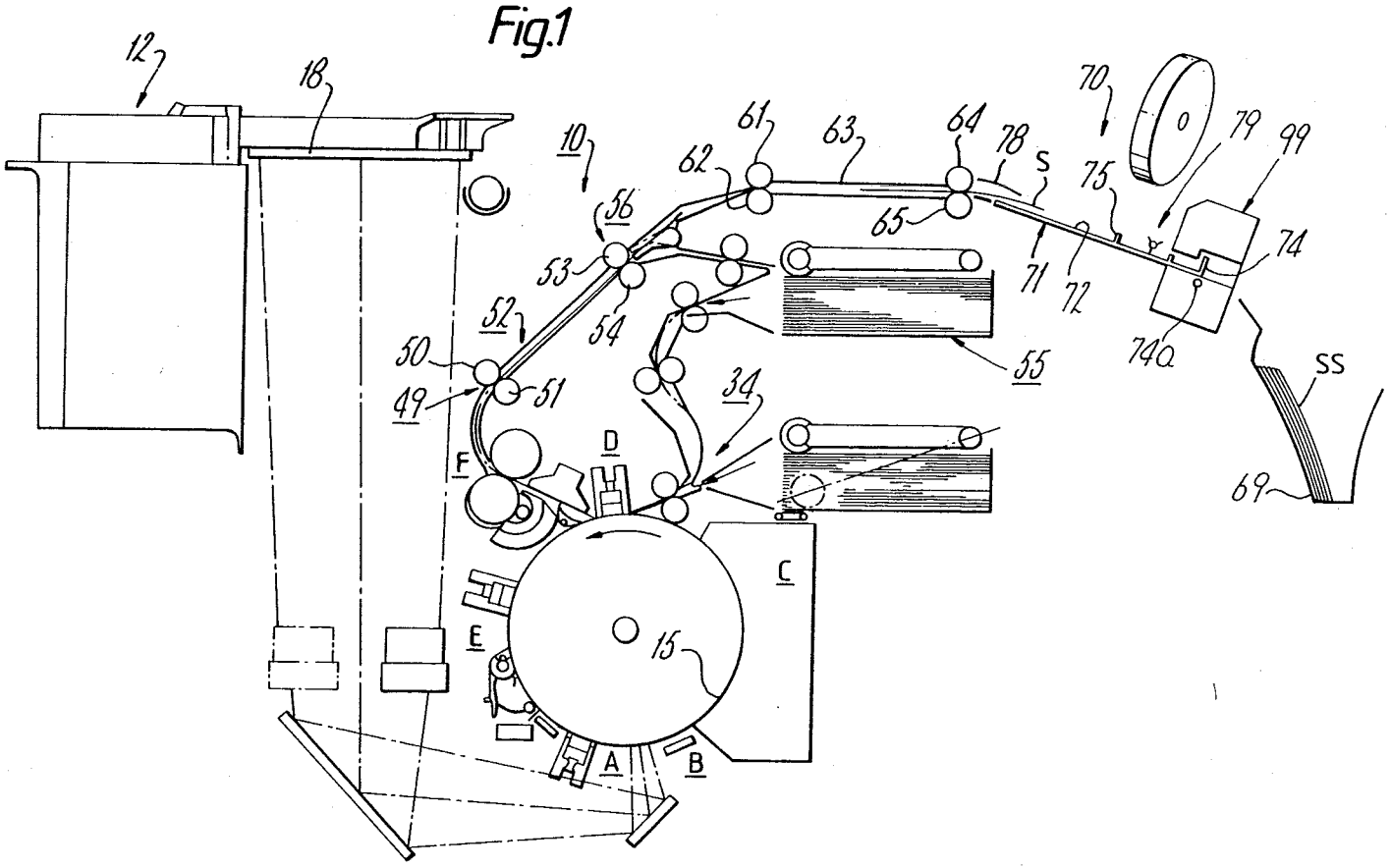

This invention relates to sheet stackers for compiling sheets delivered serially thereto into a stack.

Stacking apparatus typically act on sheets fed serially thereto to stack the sheets in registration with each other so as to provide an attractive and compact set or signature with uniform edges. The sheets may be registered against a single registration edge but for complete registration they are preferably aligned both laterally and longitudinally with respect to the direction of travel of the sheets. This may be achieved by registering two adjacent edges (one end and one side) of the sheet with respect to respective registration stops and this form of registration is termed corner registration. Stacking apparatus may be required in addition to compiling the sheets into sets to position the sheets with respect to a fixed finishing device such as a stitcher, stapler or punch. This is readily achieved by corner registration.

The invention is particularly concerned with sheet stackers in which the compiled set is fed off the support surface following the completion of compilation of the set and, if required, the binding thereof. Usually the completed sets are fed into an output tray or storage location for subsequent removal by an operator. It is known for example from U.K. Pat. No. 1,595,609 that a sheet stacker may comprise a support surface, a registration stop, means for registering sheets to form a registered stack against said registration and means for feeding the compiled stack of sheets off the surface.

Sometimes it is desirable to feed out or eject a compiled set from the compiling tray without binding the set. Rapid ejection of the set is desirable to avoid interrupting the delivery of sheets to the compiling tray. At the same time it is important that there be no set disturbance during ejection.

In accordance with this invention feed means are proposed which comprise a drive roller having a small portion of its surface projecting through the support surface and an idler roller movable between an inactive position raised above the support surface and an active postion in which it presses against the top of a stack on the support surface. Preferably the drive roller is driven so that it is already rotating when the idler roller is engaged; for this purpose the drive roller preferably rotates continuously during operation of the stacker.

It has been found that using a conventional hard plastics roller a relatively high coefficient of surface friction of about $0.8\mu$ is required in order for set ejection to be effective. This may not be suitable for unbound sets in particular since there is a tendency for premature ejection of the bottom sheet in the set. Conventional foam rollers are also not entirely satisfactory since they also tend to cause set disturbance of unbound sets. It is therefore preferred to use a drive roller having an outer surface with a low coefficient of friction and which is deformable by said idler roller pressing against a said set to increase the area of contact with the set. Preferably the drive roller has a surface coefficient of friction of less than $0.5\mu$ and a hardness of less than 40 IRHD.

In a preferred embodiment, the drive roller is formed as a composite of a hard outer skin of plastics material surrounding a soft rubber or foam inner core. The core suitably has a hardness of about 15 to 30 IRHD and the hard plastics skin around it suitably has a coefficient of friction of $0.1$–$0.3\mu$ and a thickness of between 125 and 250 microns.

In one embodiment a roller about 25 mm wide and 30 mm in diameter suitable projects through the support surface by about 2 to 4 mm. The roller is suitably sufficiently deformed during the feeding that the area of contact between the roller and the sheet in the direction of rotation of the roll is about 1.5 to 3.0 mm.

Figure 2:
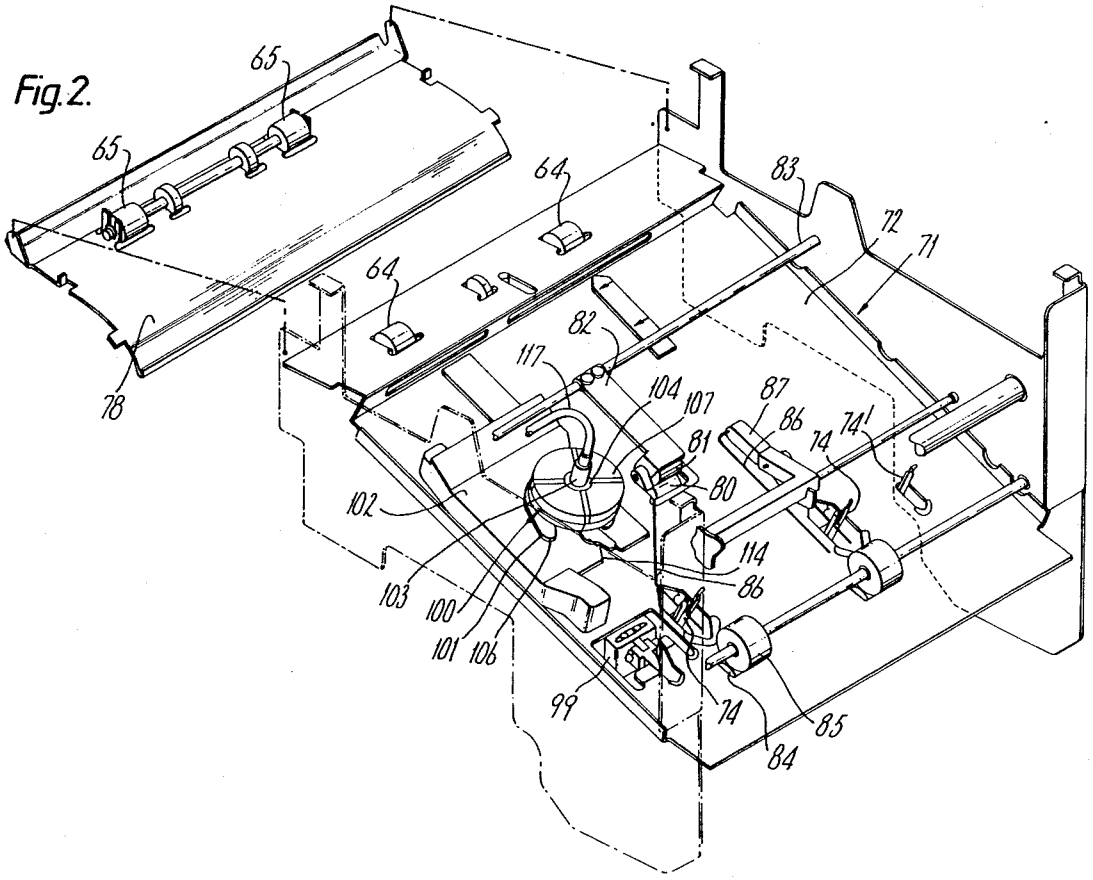
Figure 3:
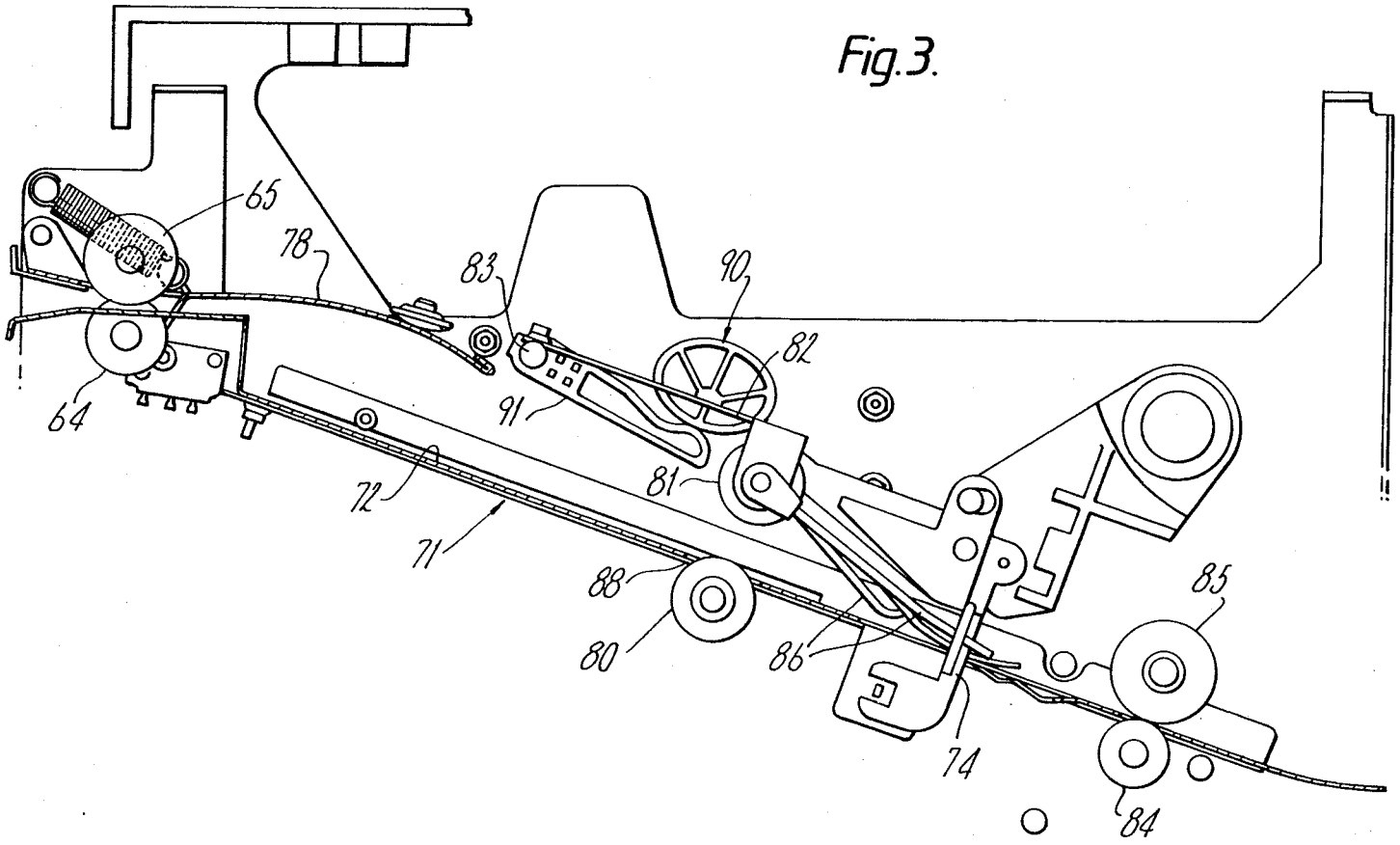
Figure 4:
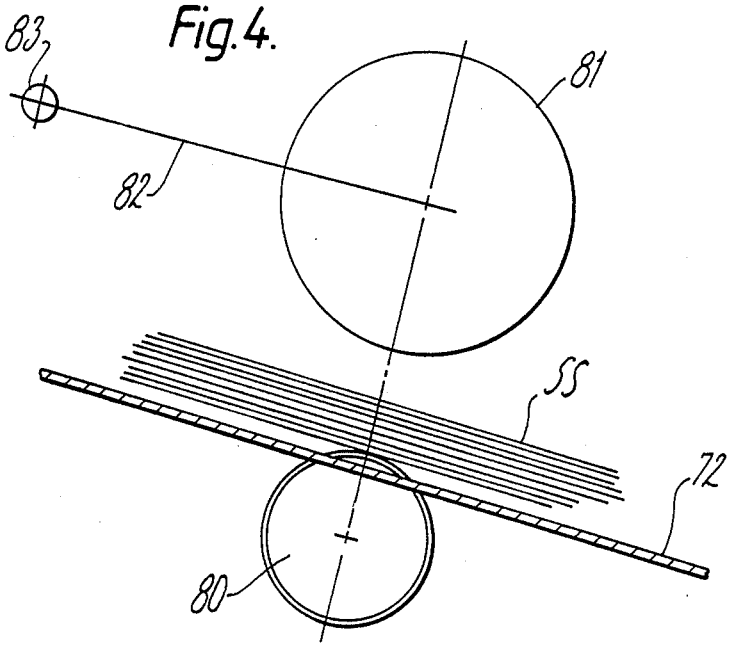
Figure 5:
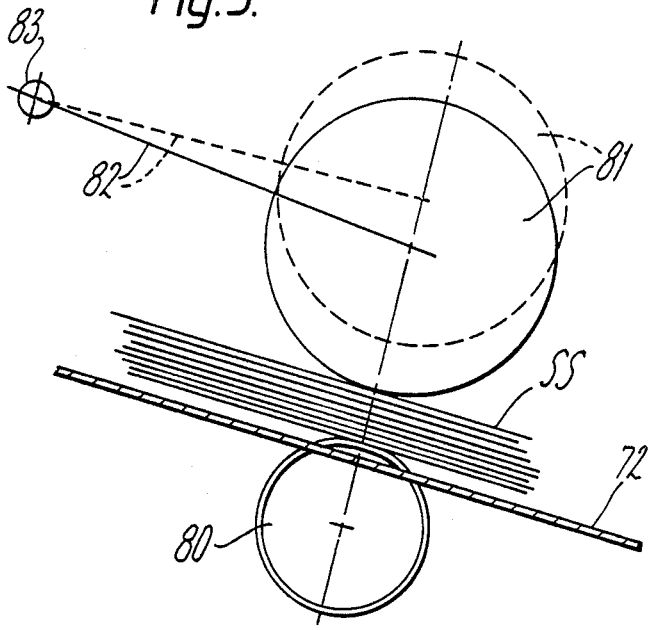
Figure 6:
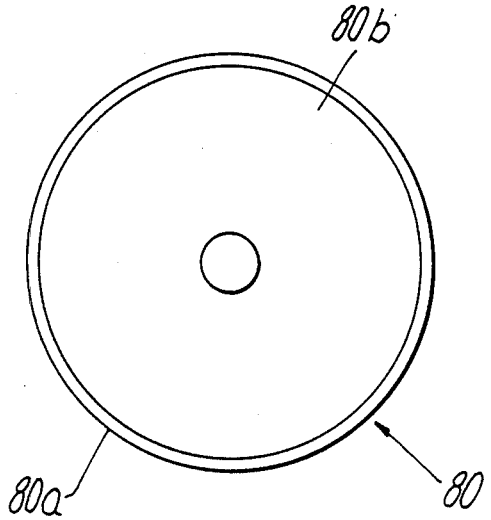

In order that the invention may be more readily understood reference will now be made to the accompanying drawings, in which:

FIG. 1 is a schematic side elevation of an exemplary form of photocopier incorporating one embodiment of sheet stacker according to this invention, FIG. 2 is a perspective view of the stacker, FIG. 3 is a side elevation of the stacker, FIG. 4 is a scrap view of the compiler tray of the sheet stacker shown during stacking, FIG. 5 is a view like that of FIG. 4 showing the apparatus during sheet ejection, and FIG. 6 is a section through the drive roller.

Referring to FIG. 1 there is shown an automatic xerographic reproducing machine 10 having a finisher 70 incorporating sheet stacking apparatus 71 according to this invention including reigstration means 79 for aligning sheets as they are stacked in the finisher prior to being acted upon by a stitcher 99. The copying machine 10 is capable of producing either simple or duplex copies in sets from a wide variety of originals which may be advanced in recirculating fashion by a recirculating document apparatus 12 described in U.S. Pat. No. 3,556,512. Although the present invention is particularly well suited for use in automatic xerography the apparatus generally designated 70 is equally well adapted for use with any number of devices in which cut sheets of material are delivered or compiled in a set or stack.

The processor 10 include a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station from sheet registering apparatus 34 in synchronous relation with the image on the drum surface. The copy sheet is stripped from the drum surface and directed to a fusing station F. Upon leaving the fuser the fixed copy sheet is passed through a curvilinear sheet guide system generally referred to as 49, incorporating advancing rollers 50 and 51. The advancing rollers forward the sheet through a linear guide system 52 and to a second pair of advancing rolls 53 and 54. At this point, depending on whether simplex or duplex copies are desired the simplex copy sheet is either forwarded directly to the finisher 70 via pinch rollers 61, 62 or, for making duplex copies, into upper supply tray 55, by means of a movable sheet guide 56. Movable sheet guide 56 and associated advancing rolls are prepositioned by appropriate machine logic to direct the individual sheets into the desired path.

The finisher 70 includes a stacking or compiling tray 71 having a base or support surface 72 inclined downwardly in the direction of sheet travel towards a registration corner defined by registration members 74, 75 along the lower edge and one side of the tray. Along the upper end of the support surface is arranged a pair of co-acting sheet feed rolls 64, 65 arranged to receive sheets fed along passage 63 by pinch rolls 61, 62. From the feed rolls 64, 65 a sheet is directed by top guide 78 into the tray 71. A corner registration apparatus 79 is arranged over the surface 72 to urge the sheets into the registration corner to position them for receiving a stitch from the apparatus 100.

The registration apparatus 79 comprises a wiper 100 having four blades 101 arranged to wipe against the sheets being registered over a limited arc of rotation defined by a swash plate 102. The wiper has a backing plate 107 incorporating a hub 104 which is mounted for rotation about an axis 103 normal to the stack support surface. It is driven by a motor through a flexible drive 117 mounted on a bracket (not shown) at the side of the tray 71. The blades 101, which are made of a resilient elastomeric material, lie in radial planes passing through the axis 103 and depend from the backing plate 107, in the direction of the axis 103, towards sheet-engaging tips 106. The wiper 100 is arranged over the stack support surface 72 so that the blades are in interference with the support surface and wipe against it. The swash plate 102 is arranged between the wipe 100 and the stack support surface 72, being spaced above and parallel to the latter, so that the blades 101 are held out of contact with the support surface by the swash plate except over limited arc of rotation defined by an arcuate opening 114 in the swash plate. The arcuate extent and position of this opening are chosen so that as the wiper 100 rotates the blades to urge the sheets into corner registration. The registration apparatus is described in greater detail in our U.S. copending patent application Ser. No. 511,034 filed concurrently herewith.

As shown in FIG. 2, wire buckle control fingers 86 are arranged to engage the top sheet of the stack adjacent to the two registration fingers 74. One of these is carried on an arm 82 and the other on a bracket 87.

The registration fence 74 comprises two fingers 74 spaced to locate A4 and similar size paper with a third finger 74' to assist in locating wider sheets. The fingers 74, 74' are rotatable about an axis **74*a* so that they may be retracted for ejection of bound sets SS in a collection tray 69** or other suitable collective device, such as a stacker which may have an elevating mechanism to increase its capacity and may be operable to offset sets or stacks delivered thereto.

Set or stack ejection is effected by a set elect mechanism according to the invention whivch comprises a drive roller 80 mounted so as to have a small portion thereof projecting upwardly through an aperture 88 in the base or stack support surface 72 of the tray 71, and a coacting idler roller 81 carried on a spring arm 82 mounted on a rail 83. The drive roller 80 is continuously driven during the operation of the stacker and when a set has been compiled the idler roller 81 is pressed down against the top of the stack (by a cam 90 acting on a lever 91 rigid with the rail 83), with sufficient pressure that the set is driven out of the compiler tray, the registration fingers 74, 74' having been retracted simultaneously with the movement of the idler roller 81. The eject rollers 80, 81 feed the stack or set into the nips of output rollers 84, 85 leading into the collection tray 69.

The drive roller 80 is suitably arranged on the centreline of the intended or most commonly used paper size, e.g. A4.

In accordance with a preferred feature of the invention, the eject drive roller 80 has a peripheral surface of a low coefficient of friction of less than 0.5$\mu$ and a hardness of less than 40 IRHD. Such a roller is able to deform when the idler roller 81 is pressed down on the set so that the surface contact with the set is increased and a lower surface coefficient of friction is required to effect transport. By giving the surface of the roller a low coefficient of friction, the problem of bottom sheet separation (premature ejection) is alleviated.

Thus the resiliency of the roller is such that adequate frictional contact may be created between the periphery of the roller and the set despite the low u of the roller surface by compressing the roller to increase the area of contact with the set.

The drive roller 80 shown in FIG. 6 is a composite roller having an outer skin **80*a* of a hard, relatively incompressible plastics material surrounding an inner core 80*b*** of soft, compressible material. The skin is formed of a heat-shrinkable plastics material, e.g. fluorinated ethylene propylene, heat shrunk on and bonded by glue to a core of natural or synthetic elastomeric material, such as phenyl silicone rubber. The skin, which is 125 to 250 microns thick, has a surface coefficient of friction of less than 0.4$\mu$ and preferably 0.1 to 0.3$\mu$. The core has a hardness of 15 to 30 IRHD. In a particular embodiment, a composite drive roller 30 mm in diameter and 25 mm wide has a surface coefficient of friction of 0.3$\mu$ and a core hardness of 21 IRHD.

In use the drive roller 80 must project through the stack support surface 82 in its uncompressed condition sufficiently that when the idler roller 81 is pressed against the top of the set the drive roller will not be compressed below the level of the stack support surface 72. A projection of about 2–4 mm, preferably 2 mm, has been found satisfactory for a roller as described above.

The force applied against the stack and thus the drive roller 80 by the idler roller 81 will increase with increase in set thickness and for a roller as described above a force varying between 20 Newtons for a two-sheet set and 80 Newtons for a 7.5 mm thick set has been found satisfactory.

It will be appreciated that various modifications may be made to the specific details referred to herein without departing from the scope of the invention as defined in the appended claims.

I claim:

1. A sheet stacker for compiling sheets delivered serially thereto in a stack having a support surface inclined slightly relative to a horizontal plane, a registration stop, means for registering sheets to form a registered stack against said registration stop, and means for feeding a compiled stack of sheets off the surface, the improvement wherein the feeding means comprises a drive roller having a small portion of its surface projecting through said support surface and upon which sheets are placed during compiling of the sheets and an idler roller movable between an inactive position raised above the support surface and an active position in which it presses against the top of a said stack, and means for driving said drive roller before said idler roller is moved to said active position, said drive roller having an outer surface with a low coefficient of friction and being deformable by said idler roller pressing against a set to increase the area of contact with the set, said rollers cooperating when said idler roller is in said active position to feed a said stack off the surface.

2. A sheet stacker according to claim 1 in which said drive roller is composed of an outer skin of plastics material having a surface coefficient of friction of less than 0.5μ surrounding a soft inner core having a hardness of less than 40 IRHD.

3. A sheet stack according to claim 2 in which said skin is composed of a heat shrinkable plastics material, such as fluorinated ethylene propylene, and said core is composed of an elastomeric material, such as phenyl silicone rubber.

4. A sheet stacker according to claim 1 in which the force applied by the idler roller is between 20 and 80 Newtons depending on the thickness of the stack.

5. A sheet stacker according to claim 1 in which the registration stop is arranged in the path of sheets conveyed on to the support surface and the compiled set is ejected in the same direction, said registration stop being retractable.

* * * * *